US005816169A

United States Patent [19]

MacKenzie

[11] Patent Number: 5,816,169

[45] Date of Patent: Oct. 6, 1998

[54] MODEL MONORAIL SYSTEM

[76] Inventor: Kenneth J. MacKenzie, 3810 5th St. E., Bradenton, Fla. 34208

[21] Appl. No.: 733,557

[22] Filed: Oct. 21, 1996

[51] Int. Cl.[6] ..... A63H 19/00

[52] U.S. Cl. ..... 105/141; 105/157.2; 104/118; 104/53; 104/124; 104/288; 104/130.01; 191/45 R

[58] Field of Search ..... 104/28, 118, 119, 104/120, 124, 126, 130.01, 130.06, 288, 242, 245, 246, 247; 105/1.5, 3, 141, 144, 157.2, 238.2; 213/75 TC; 191/45 R, 59.1, 60, 60.2, 60.3

[56] References Cited

U.S. PATENT DOCUMENTS

| | | | |
|---|---|---|---|
| 3,093,090 | 6/1963 | Rosenbaum | 104/118 |
| 3,115,845 | 12/1963 | Girz | 104/119 |
| 3,550,535 | 12/1970 | Rooklyn | 104/118 |
| 3,570,177 | 3/1971 | Tomaro | 104/118 |
| 3,581,987 | 6/1971 | Tomaro | 104/118 |
| 3,608,237 | 9/1971 | Richter | 213/75 TC |
| 3,610,162 | 10/1971 | Lawrence | 104/118 |
| 3,859,682 | 1/1975 | Sulkiewicz | 104/124 |
| 4,031,662 | 6/1977 | Beshany | 104/118 |

*Primary Examiner*—Mark T. Le
*Attorney, Agent, or Firm*—Dorothy S. Morse

[57] ABSTRACT

A model monorail system having at least one engine and at least one car coupled thereto, both being configured to move along a single upper rail member that is supported in an elevated position by a plurality of upright rail supports. In the preferred embodiment, each monorail engine assembly comprises one front wheel subassembly with a rotatable front wheel, one wheel subassembly with counter-rotating drive wheels, two weighted electrical pick-up subassemblies which are also pivotal, pivotal wheel-coupler assemblies attached to each end of each car assembly, as well as a plurality of safety arm subassemblies and a plurality of roller arm subassemblies, which together surround the upper surface, both side surfaces, and the bottom surface of the upper rail member to securely maintain the engine assemblies and coupled car assemblies in position on top of the upper rail member at all times during use.

17 Claims, 12 Drawing Sheets

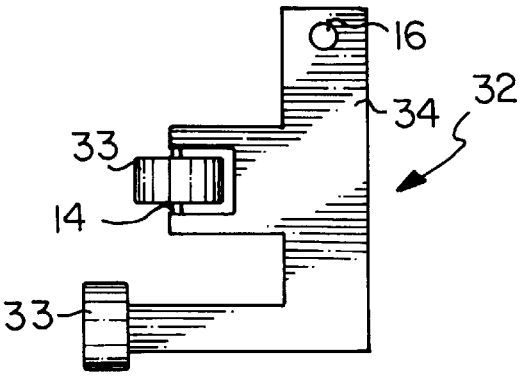
FIG. 3c
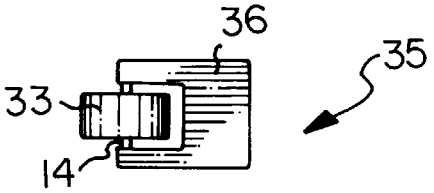
FIG. 3d
FIG. 4
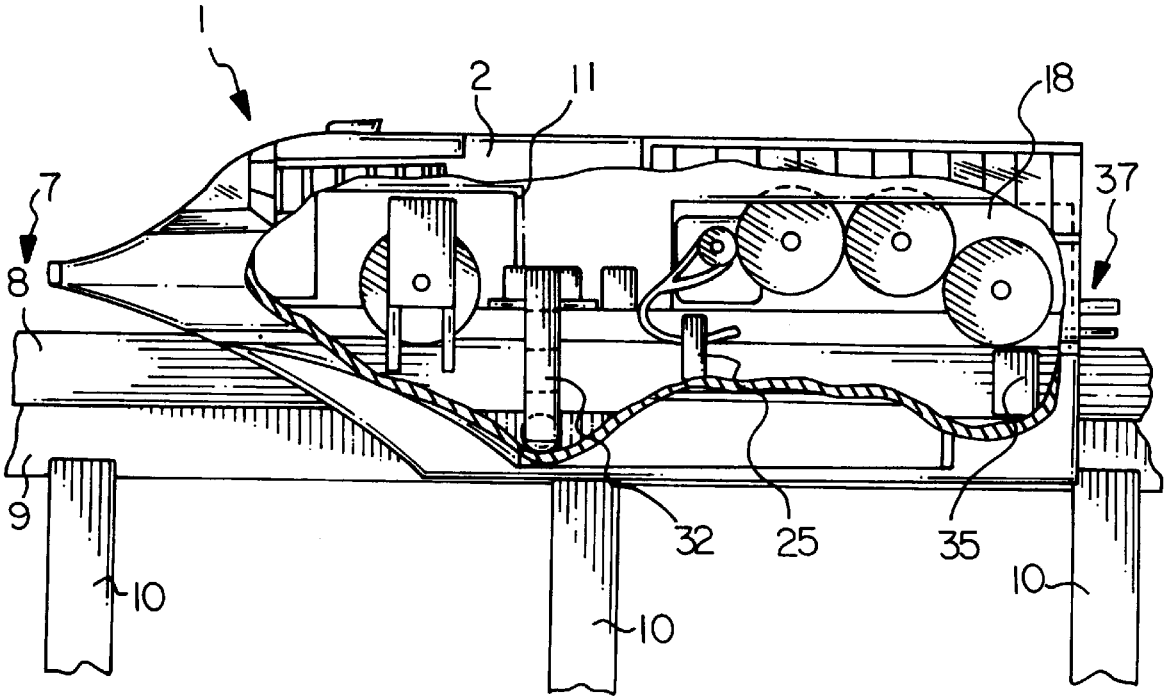

MODEL MONORAIL SYSTEM

BACKGROUND

1. Field of Invention

This invention relates to model transportation systems, specifically to a model monorail system having at least one engine and at least one car coupled to the engine, both being configured to operate on a single upper rail member that is supported in an elevated position by a plurality of upright supports, each monorail engine comprising one front wheel subassembly, one rear wheel subassembly, at least one electrical pick-up subassembly, as well as a plurality of safety arm subassemblies and a plurality of roller arm subassemblies, which together surround the upper surface, side surfaces, and the bottom surface of the upper rail member to maintain the engines and coupled cars on top of the upper rail member at all times during use.

BACKGROUND

2. Description of Prior Art

It is known to have electric model railroad systems with dual rails upon which train engines and coupled cars are supported during use. It is also known to have electric racing assemblies for model automobiles and motorcycles with track sections which comprise a central slot therein to guide the racing vehicles and keep them positioned on top of the track during use. Although the track upon which model railroad engines operate may be elevated, such as when used upon a trestle bridge, each section of railroad track always comprises two electrically conductive rails which are spaced apart by a uniform distance and is always engaged by engines having two or more pairs of wheels, one wheel of each pair typically engaging the upper surface and one side of one of the rails. Further, model railroad engines and cars are easily placed upon and lifted from the rails and do not have components which surround the upper surface, both sides, and the bottom surface of the rails to maintain them in their operating position upon the track, as do the engines and cars of the present model monorail invention. Also in contrast to the present invention, racing assemblies for model vehicles are known to comprise track sections having a flat upper surface with a central slot or narrow groove therein so that when shafts attached to the bottom surface of each model vehicle are inserted into the slot or groove, the shafts guide each vehicle along the track and help to keep it positioned on the upper surface of the track during use. Magnetic components positioned adjacent to the slot or groove are also used to help keep such model vehicles from leaving the track surface at speed. However, even when the vehicles are magnetically attracted to the track, model racing vehicles are known to become separated from the track when moving at high speeds through curved sections of the track. It is not known in the field of model transportation systems to have a model monorail system comprising at least one engine, and at least one car coupled to the engine, all of which are configured to operate on a single upper rail member supported in an elevated position by a plurality of upright rail supports, each monorail engine thereof comprising one front wheel subassembly, one rear wheel subassembly, at least one electrical pick-up subassembly, as well as a plurality of safety arm subassemblies and a plurality of roller arm subassemblies which have components that surround the upper surface, both sides, and the bottom surface of the upper rail member to maintain the engine and cars on top of the upper rail member during use.

SUMMARY OF INVENTION—OBJECTS AND ADVANTAGES

It is the primary object of this invention to provide a model monorail system comprising at least one engine and at least one car movable along an elevated single upper rail member, engines which are able to draw power from the upper rail member for such movement, and engines and coupled cars which have components surrounding the upper surface, both sides, and bottom surface of the upper rail member to maintain them in position upon the upper rail member during use. It is also an object of this invention to provide a model monorail system with rail and engine components which can be easily manufactured to dimensions commonly used for model railroad systems, such as HO gauge model railroad systems. A further object of this invention is to provide a model monorail system which is made from a limited number of subassemblies for reduced manufacturing cost.

As described herein, properly manufactured and assembled for use, the present invention would provide a plurality of track each sections comprising a single upper rail member, at least one engine, and at least one car coupled to the engine, the engine being secured around the upper surface, both sides, and the bottom surface of the upper rail member at speed by a plurality of roller arm subassemblies and a plurality of safety arm subassemblies. Each upper rail member would be attached to a plurality of upright rail supports by a narrow middle rail member centrally connected to the bottom surface of the upper rail member in a manner that allows components in the engines and coupled cars to be positioned adjacent to lateral portions of the bottom surface of the upper rail member to keep them from becoming separated from the track at speed. Each engine would comprise at least one direct current motor electrically connected to one or more electrical pick-up subassemblies attached to the engine for drawing power from a direct current power source through one or more electrically conductive strips attached to the upper surface of each section of the upper rail member. Each engine would also comprise at least one front wheel, at least one one rear drive wheel, a plurality of gears connected between the rear drive wheel and the direct current motor, and at least two safety arm subassemblies for maintaining the engine upon the upper rail member, each safety arm subassembly comprising at least one roller positioned against one side of the upper rail member and a second roller positioned adjacent to the narrow middle rail member to laterally engage the bottom surface of the upper rail member when necessary to maintain the engine in its position upon the upper rail member. Each engine and cars coupled thereto are connected together by male and female couplers profiled for non-interference with the upper rail member, the couplers on the cars being part of the car wheel subassemblies and comprising a pair of adjacent wheels positioned which engage with the upper surface of the upper rail member. In the preferred embodiment, sections of the rail assembly are connected together by opposed fastening plates attached to the sides of adjacent sections of the middle rail members and spanning across the ends thereof, in addition to pegs positioned in opposed grooves formed within the ends of adjacent upper rail members. It is also contemplated for the monorail system to have switches comprising electromagnets attached thereto to attract a swivel rail member against a swivel stop so that an engine upon the swivel rail member can selectively travel onto one of several sections of rail provided on the exiting portion of the switch. In addition, the rails may be associated with buildings having bores therethrough configured to house upper rail members, middle rail members, as well as engine assemblies and car assemblies placed thereon, and also configured so that engine assemblies and car assemblies can leave the rail assembly, enter each building, then exit each building on additional sections of the rail assembly. It is also contemplated for the buildings to have model railroad track attached thereto so that the present invention may be operated in conjunction with model railroad apparatus.

The description herein provides preferred embodiments of the present invention but should not be construed as limiting the scope of the model monorail system invention. For example, variations in configuration and dimension of the engine shells and the car shells, the number of attachment blocks used within the engine shells, the number of drive gears used in each engine, the number of safety arm assemblies used in each car and engine, the number of upper rail members associated with each building, the number of fastening plates used to interconnect adjacent sections of rail, and the number and widths of the electrically conductive strips used on the upper surface of the upper rail member to provide power for the monorail engines, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 3*c* is a front view of the safety arm subassembly used for both the engines and cars of the present invention.

FIG. 3*d* is a front view of the roller arm subassembly of the present invention.

FIG. 4 is a sectional view of the first embodiment of the engine assembly positioned on a rail assembly.

DETAILED DESCRIPTION OF PREFERRED EMBODIMENTS

Figure 1:
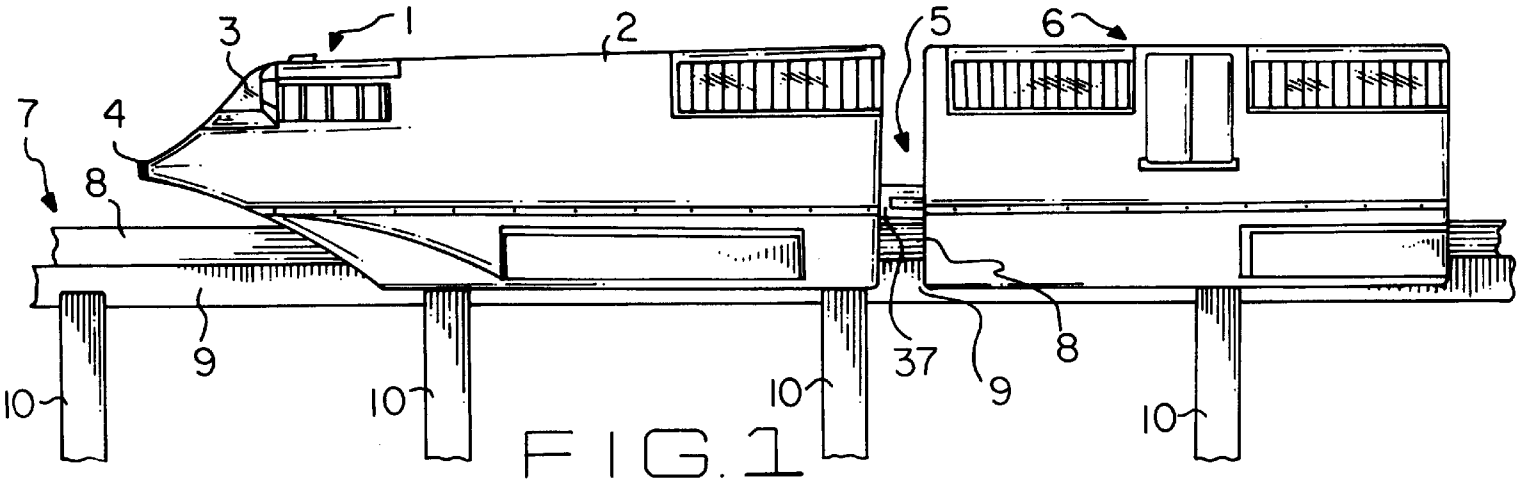
FIG. 1 is a side view of a first preferred embodiment of the engine assembly of the present invention coupled to a car and positioned on a rail assembly.

FIG. 1 shows a first preferred embodiment of a monorail engine assembly 1 coupled to a car assembly 6 and positioned on a rail assembly 7 comprising an upper rail member 8, a middle rail member 9, and a plurality of upright rail supports 10. FIG. 1 also shows engine assembly 1 having an engine shell 2 which is configured to extend downwardly on either side of rail assembly 7, obscuring from view both upper rail member 8 and most of middle rail member 9 when engine assembly 1 is supported for use upon upper rail member 8. Engine assembly 1 is coupled to car assembly 6 through interconnection of a wheel-coupler assembly 5 on car assembly 6 and a female coupler 37 attached to engine assembly 1. The configuration of engine shell 2, and the type of decorative markings (not shown) on its outer surface, are not critical to the present invention. However, it is contemplated for engine shell 2 to have a headlight 4 positioned to shine through the forwardmost leading surface of engine shell 2 and a windshield 3 also positioned on the leading surface of engine shell 2 above and rearward from headlight 4. The material from which engine shell 2 is made is not critical to the present invention, however, such material should be rigid and lightweight. In the preferred embodiment, engine shell 2 is made from plastic materials.

Figure 2B:
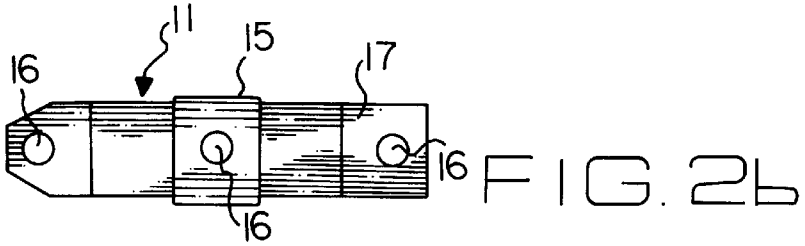
FIG. 2*b* is a top view of the front wheel assembly.
Figure 2C:
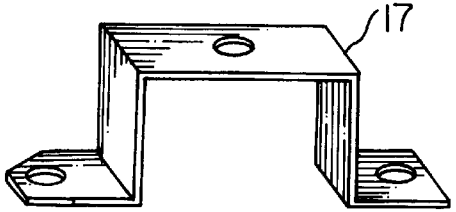
FIG. 2*c* is a side view of the outer wheel frame of the front wheel assembly.
Figure 2A:
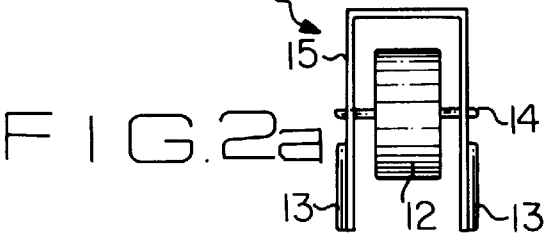
FIG. 2*a* is an end view of the front wheel assembly of the engine of the present invention.

FIGS. 2*a*, 2*b*, and 2*c* show a front wheel subassembly 11 for use in supporting the front portion of engine assembly 1 upon rail assembly 7. FIG. 2*a* shows front wheel subassembly 11 having an engine wheel 12 supported for rotation upon an axle 14. Axle 14 is supported on both of its ends by an inverted U-shaped inner wheel frame 15. In the preferred embodiment it is contemplated for inner wheel frame 15 to be made from sheet metal. FIG. 2*a* also shows a wheel guide 13 connected to the outside portion of each arm of U-shaped inner wheel frame 15. In the preferred embodiment it is contemplated for four wheel guides 13 to engage the upper side portions of upper rail member 8 when engine assembly 1 is positioned upon rail assembly 7, to help turn and guide engine wheel 12 on curved portions of rail assembly 7. To also help engine wheel 12 turn and follow the curvature of rail assembly 7, inner wheel frame 15 is movably mounted within an outer wheel frame 17, shown in FIGS. 2*b* and 2*c*. FIG. 2*b* shows front wheel subassembly 11 having inverted U-shaped inner wheel frame 15 positioned within outer wheel frame 17 which is also essentially U-shaped with lateral extensions for use in connecting front wheel subassembly 11 to engine base 39, shown in FIG. 5*b*. FIG. 2*b* also shows fastener holes 16 centrally positioned through each lateral extension of outer wheel frame 17, as well as one fastener hole 16 centrally positioned therebetween for movably connecting U-shaped inner wheel frame 15 to outer wheel frame 17. The type of fastener used for insertion through fastener holes 16 is not critical to the present invention and is not shown. However, in the preferred embodiment it is contemplated for the fasteners used through fastener holes 16 to comprise a variety of sizes of conventional screws and nuts. FIG. 2*c* shows the inverted U-shape of outer wheel frame 17 with a lateral extension on each of its ends.

Figure 2D:
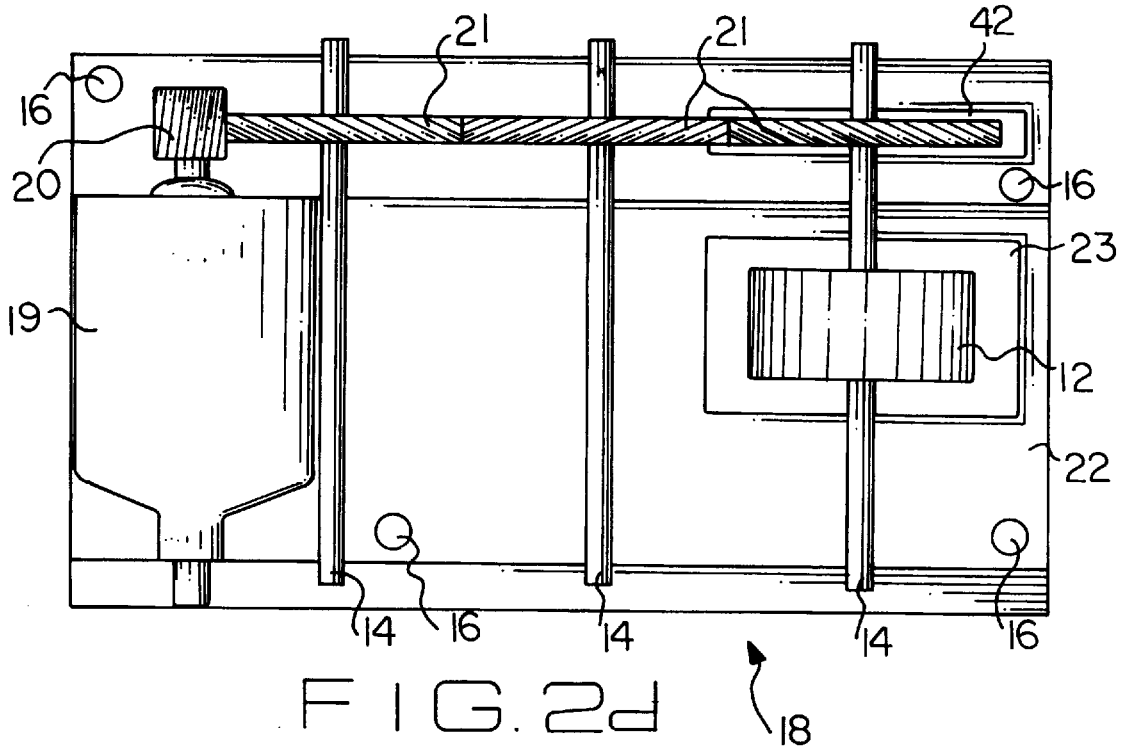
FIG. 2*d* is a top view of the drive subassembly of the first embodiment of the engine assembly.
Figure 2E:
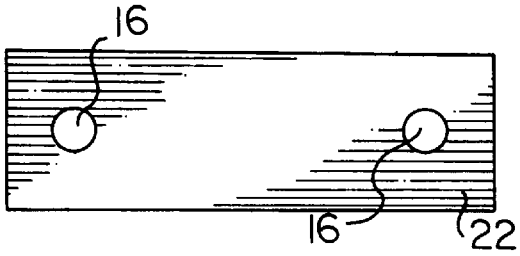
FIG. 2*e* is a rear view of the drive subassembly.
Figure 2F:
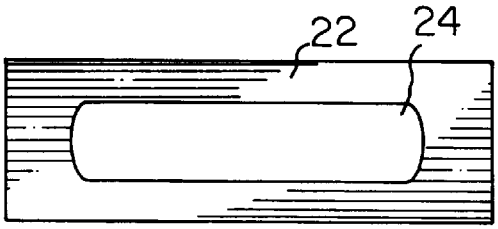
FIG. 2*f* is a front view of the drive subassembly.

FIGS. 2*d*, 2*e*, and 2*f* show a first preferred embodiment of a drive subassembly 18 for engine assembly 1. FIG. 2*d* shows drive subassembly 18 having a drive subassembly frame 22 with four fastener holes 16 therethrough for connection of drive subassembly 18 to engine base 39, shown in FIG. 5*b*. FIG. 2*d* also shows drive subassembly 18 having a direct current motor 19 attached to drive subassembly frame 22 and connected on one of its ends to a pinion gear 20. In the preferred embodiment it is contemplated for drive subassembly frame 22 to comprise two horizontal pieces of sheet metal with openings therethrough for positioning of direct current motor 19 and axles 14. FIG. 2*d* further shows pinion gear 20 engaging one of three interconnecting gears 21, each gear 21 being supported for rotation upon an axle 14 which is attached to drive subassembly frame 22. In addition, a rear engine wheel 12 is supported upon the same axle 14 used for support of the rearwardmost gear 21. FIG. 2*d* also shows the rearwardmost gear 21 being positioned through a gear opening 42 and rear engine wheel 12 being positioned through a rear wheel opening 23 for contact with the upper surface of upper rail member 8. FIG. 2*e* shows drive subassembly frame 22 having two spaced apart fastener holes positioned through its rear wall for connection of drive subassembly 18 to engine shell 2. FIG. 2*f* shows drive subassembly frame 22 having a ventilation opening 24 centrally located through its front wall for allowing air (not shown) to circulate around direct current motor 19 during its operation.

Figure 3A:
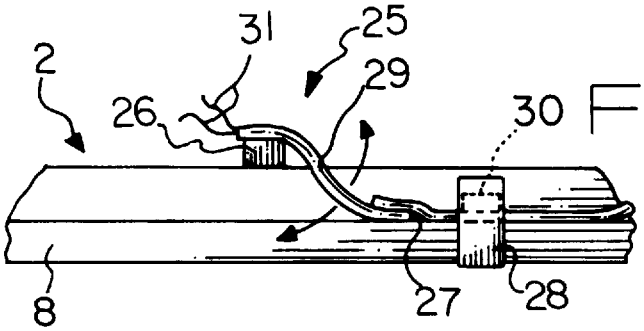
FIG. 3*a* is a side view of the electrical pick-up subassembly of the engine of the present invention.

FIG. 3*a* shows an electrical pick-up subassembly 25 positioned against upper rail member 8 for providing power to motor 19 for movement of engine assembly 1 along rail assembly 7. FIG. 3*a* shows electrical pick-up subassembly 25 having an elongated electrical pick-up 29 in contact with upper rail member 8 and an electrical pick-up guide 28 positioned over the lower portion of elongated electrical pick-up 29 to keep elongated electrical pick-up 29 aligned on upper rail member 8 during forward or backward movement of engine assembly 1 along rail assembly 7. A weight 30 is placed between electrical pick-up guide 28 and the lower portion of elongated electrical pick-up 29 to bias elongated electrical pick-up 29 against the upper surface of upper rail member 8 and place it in contact with electrical strips 38, shown in FIG. 14*a*. Weight 30 is attached to the inner surface of electrical pick-up guide 28. The upper portion of electrical pick-up 29 is supported by attachment block 26 which allows vertical movement of electrical pick-up 29 and electrical pick-up 29 has a pivot point 27 between its upper and lower portions, also positioned between electrical pick-up guide 28 and attachment block 26 to allow horizontal movement of the lower portion of electrical pick-up 29. It is contemplated for attachment block 26 to be positioned within engine shell 2. Also, FIG. 3*a* shows wiring 31 connected to the end of the upper portion of electrical pick-up 29 housed within engine shell 2. In the preferred embodiment it is contemplated for electrical pick-up guide 28 to have an inverted U-shape and be made from plastic or other non-conductive material. Although not shown, it is also contemplated for electrical pick-up guide 28 to be insulated. Further, in the preferred embodiment it is contemplated for electrical pick-up 29 to be made from copper.

Figure 3B:
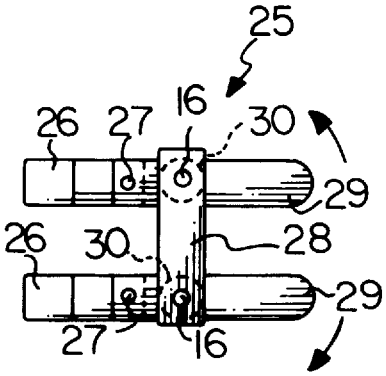
FIG. 3*b* is a top view of the electrical pick-up subassembly.

FIG. 3*b* shows two electrical pick-up subassemblies 25 being positioned adjacent to one another, each having one electrical pick-up 29 and a weight 30 positioned on top of the lower portion of electrical pick-up 29, with a single electrical pick-up guide 28 attached to the top of both weights 30 eletrical pick-up guide 28 rides on each side of upper rail member 8 so that weight 30 keep electrical pick-ups 29 in contact with electrically conductive strips 38 attached to the upper surface of upper rail member 8 and electrical pick-up guide 28 also rides on each side of upper rail member 8 to keep both electrical pick-ups 29 aligned horizontally on upper rail member 8. FIG. 3*b* also shows electrical pick-up subassemblies 25 each having the upper portion of electrical pick-up 29 supported by one attachment block 26, and a lateral pivot point 27 between the upper and lower portions of each electrical pick-up 29, and further positioned between electrical pick-up guide 28 and its associated attachment block 26. It is contemplated for electrical pick-ups 29 to move up and down relative to attachment blocks 26 during use. Also, it is contemplated for electrical pick-ups 29 to move laterally at pivot point 27 so that electrical pick-ups 29 can follow curved sections of rail assembly 7. FIGS. 3*a* and 3*b* show the location of pivot point 27 instead of the structural details of the pivot.

FIG. 3*c* shows a preferred embodiment of a safety arm subassembly 32 used to help maintain engine assembly 1 upon rail assembly 7. Safety arm subassembly 32 comprises an inverted F-shaped roller support member 34 with two rollers 33 attached thereto. FIG. 3*c* shows the upper roller 33 positioned upon axle 14 for rotation. The lower roller 33 is positioned upon the bottom protrusion of inverted F-shaped roller support member 34 with the axle 14 to which it is connected oriented perpendicular to the vertical main portion of inverted F-shaped roller support member 34. The upper roller 33 is positioned upon the middle protrusion of inverted F-shaped roller support member 34 with the axle 14 to which it is connected oriented parallel to the vertical main portion of inverted F-shaped roller support member 34. While neither roller 33 is in continuous contact with rail assembly 7, the upper roller 33 keeps engine assembly 1 centered upper rail member 8, while the lower roller 33 is positioned adjacent to the lateral bottom surface of upper rail member 7 to keep engine assembly 1 from lifting upward and away from the upper surface of upper rail member 8. The middle protrusion of inverted F-shaped roller support member 34 has a cutout through its distal end with roller 33 partially positioned therein. FIG. 3*c* also shows the vertical main portion of inverted F-shaped roller support member 34 having one fastener hole 16 positioned through its upper end. It is contemplated for both engine assemblies I and car assemblies 6 to comprise safety arm subassemblies 32 for maintaining both on rail assembly 7 at speed.

FIG. 3*d* shows a preferred embodiment of a roller arm subassembly 35 having a roller support member 36 with a cutout through one of its ends and one roller 33 supported upon one axle 14 for rotation, the ends of axle 14 being affixed across the cutout so that roller 33 is partially positioned therein. During use, roller 33 in each roller arm subassembly 35 in not in continuous contact with middle rail member 9, but is positioned adjacent to middle rail member 9 to keep the rear portion of engine assembly 1 centered horizontally on rail assembly 7. It is contemplated for engine assembly 1 to comprise multiple roller arm subassemblies 35, as many as are needed for efficient operation of engine assembly 1 upon rail assembly 7.

FIG. 4 shows the first embodiment of engine assembly 1 positioned on rail assembly 7. FIG. 4 shows rail assembly 7 having an upper rail member 8, several upright rail supports 10 under upper rail member 8, and middle rail member 9 positioned therebetween. FIG. 4 further shows front wheel subassembly 11 positioned in the forward portion of engine assembly 1, with one safety arm subassembly 32 positioned rearward therefrom. Electrical pick-up subassembly 25 is positioned next behind safety arm subassembly 32. Rearward to electrical pick-up subassembly 25, FIG. 4 shows drive subassembly 18 connected to electrical pick-up subassembly 25, and roller arm subassembly 35 positioned below drive subassembly 18 near the back of engine assembly 1. Connected to the back of end of engine shell 2, FIG. 4 shows a female coupler 37. Although not shown, it is contemplated for the first preferred embodiment of engine assembly 1 to comprise two safety arm subassemblies 32, two electrical pick-up assemblies 25, and two roller arm subassemblies 35.

Figure 5A:
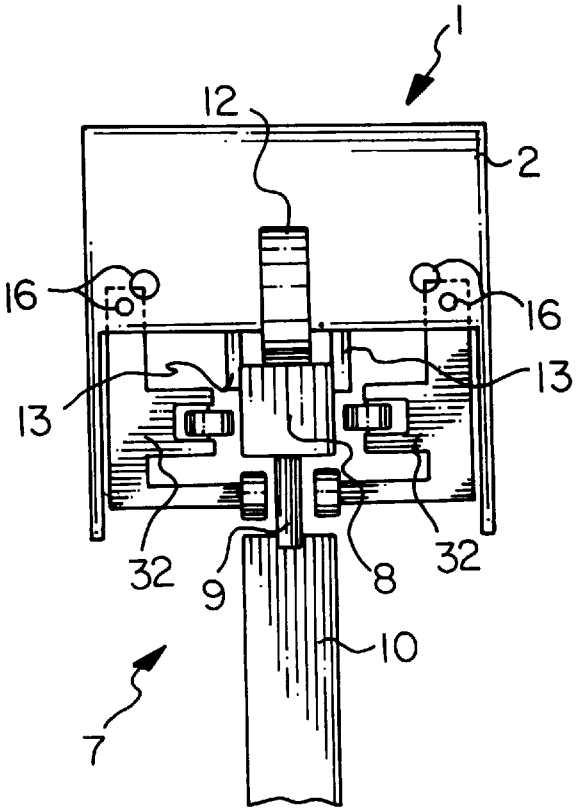
FIG. 5*a* is a sectional end view of the first embodiment of the engine assembly positioned on a rail assembly.

FIG. 5*a* shows the first embodiment of engine assembly 1 positioned on rail assembly 7 having upper rail member 8, one upright rail support 10, and middle rail member 9 positioned therebetween. Rear engine wheel 12 is positioned to contact the upper surface of upper rail member 8. FIG. 5*a* also shows engine assembly 1 having two safety arm subassemblies 32, one safety arm subassembly being positioned adjacent to opposed sides of upper rail member 8. In addition, FIG. 5*a* shows wheel guides 13 which are attached to front wheel subassembly 11 and are positioned adjacent to opposed sides of upper rail member 8, as well as two spaced apart fastener holes 16 laterally positioned through engine shell 2 that are used to attach engine shell 2 to drive subassembly 18 to further help hold engine shell 2 to engine base 39. The other two fastener holes 16 are positioned through the upper portions of the two safety arm subassemblies 32.

Figure 5B:
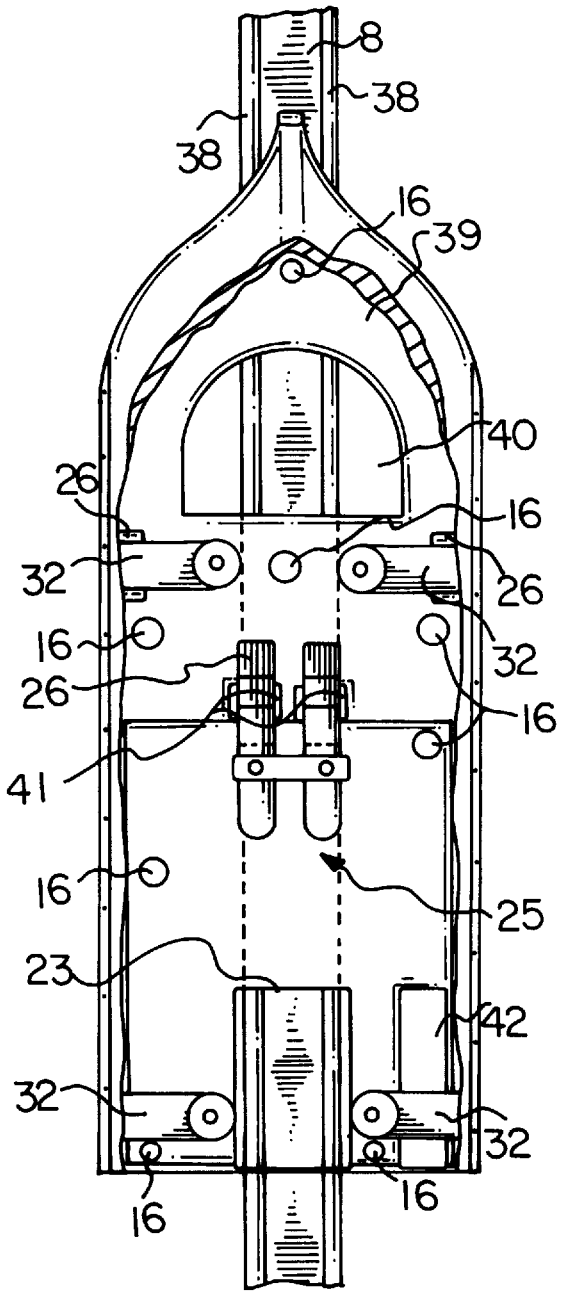
FIG. 5*b* is a top view of the base member of the first embodiment of the engine assembly positioned on a rail.

FIG. 5*b* shows a first embodiment of an engine base 39 positioned on upper rail member 8 and having a front wheel opening 40, two centrally located electrical pick-up openings 41, a rear gear opening 42, and rear wheel opening 23. In addition, FIG. 5*b* shows engine base 39 having eight fastener holes 16 therethrough. Front wheel opening 40 is dimensioned to accommodate front engine wheel 12 as it turns to follow curved portions of rail assembly 7. Positioned rearward from front wheel opening 40, FIG. 5*b* shows two safety arm subassemblies 32 connected to two attachment blocks 26 laterally positioned on engine base 39. Also, positioned between front wheel opening 40 and rear wheel opening 23, rearward to safety arm subassemblies 32, FIG. 5*b* shows two electrical pick-up subassemblies 25 positioned through electrical pick-up openings 41. Lateral to rear wheel opening 23, on one of its sides, FIG. 5*b* shows gear opening 42 for allowing the rearwardmost gear 21, which is positioned for rotation on the same axle 14 upon which rear engine wheel 12 is positioned and therefore extends below engine base 39, to rotate freely without hindrance from engine base 39. In addition, lateral to rear wheel opening 23, FIG. 5*b* shows two roller arm subassemblies 35, the rollers 33 of which are positioned adjacent to middle rail member 9 to keep engine assembly 1 centered upon rail assembly 7 during operation. Further, FIG. 5*b* shows engine base 39 having drive subassembly 22 positioned rearward of safety arm subassemblies 32. The two centrally positioned fastener holes 16 in front of and behind front wheel opening 40 are contemplated for attachment of opposed ends of outer wheel frame 17. The two fastener holes 16 shown in FIG. 5*b* behind the forward two fastener holes 16 are contemplated for attachment of engine base 39 to engine shell 2. The four rear fastener holes 16 are contemplated for use in attaching drive subassembly 18 to engine base 39.

Figure 6:
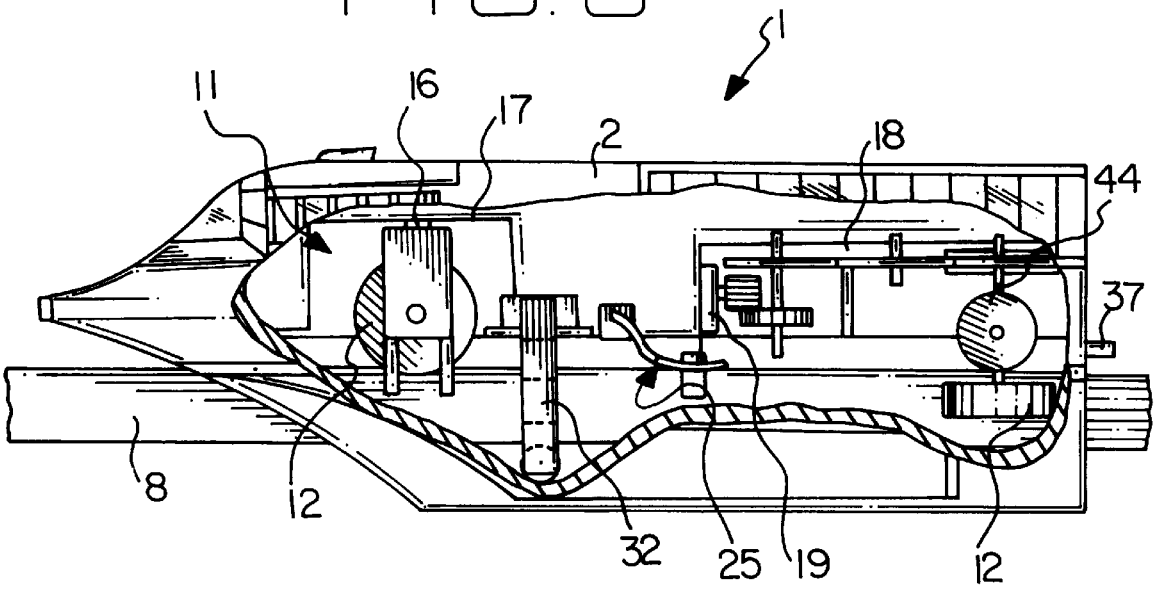
FIG. 6 is a sectional side view of a second preferred embodiment of the engine assembly positioned on a rail assembly.

FIG. 6 shows a second embodiment of engine assembly 1 positioned on upper rail member 8 and having front wheel subassembly 11 connected thereto, safety arm subassembly 32 positioned rearward of front wheel subassembly 11, and drive subassembly 18 positioned rearward from safety arm subassembly 32. In addition, FIG. 6 shows direct current motor 19 and electrical pick-up subassembly 25 positioned rearward of safety arm subassembly 32, being safety arm subassembly 32 connected to attachment block 26, one rear engine wheel 12, one reduced-size engine wheel 44, and a female coupler 37 attached through the outside rear surface of engine shell 2. Further, FIG. 6 shows the inverted U-shaped configuration of outer wheel frame 17 which supports front engine wheel 12 for rotation through an attachment hole 16 centrally located through the upper portion of outer wheel frame 17. Although not shown, it is contemplated for the second preferred embodiment of engine assembly 1 to comprise two safety arm subassemblies 32, two electrical pick-up assemblies 25, and two rear engine wheels 12 which counter-rotate to drive engine assembly 1.

Figure 7:
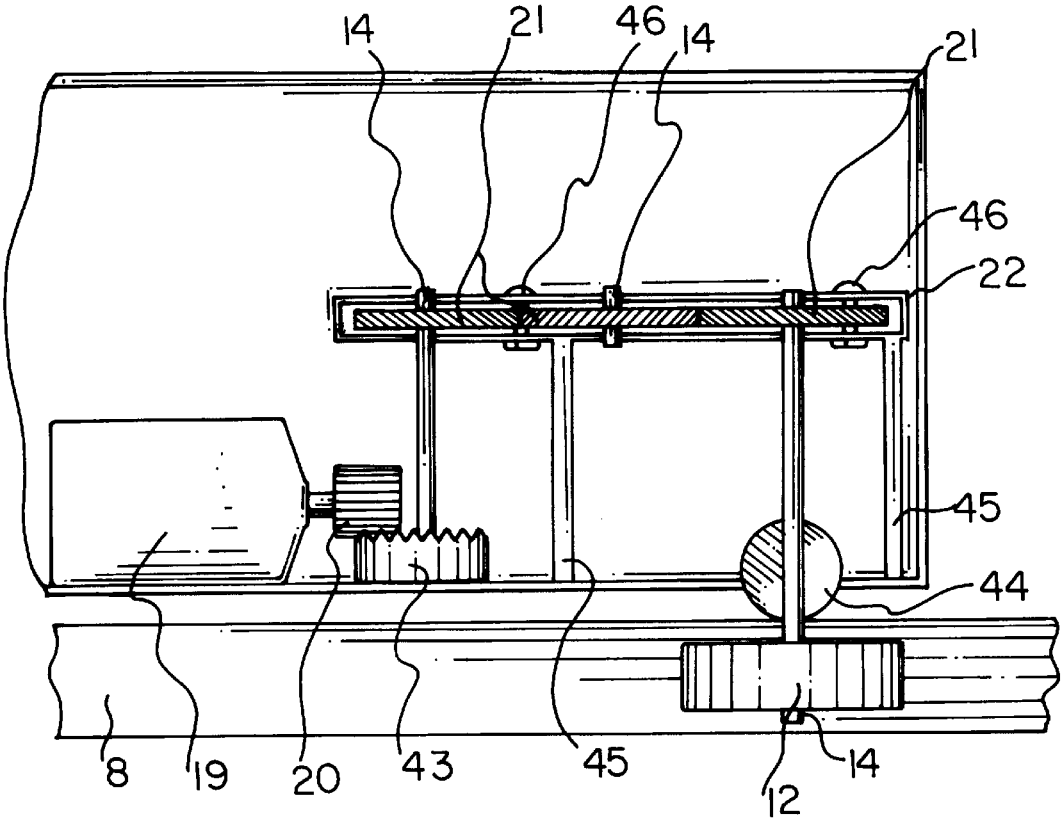
FIG. 7 is an enlarged side view of the drive subassembly of the second embodiment of the engine assembly.

FIG. 7 shows the orientation of components in drive subassembly 18 of the second preferred embodiment of engine assembly 1. Motor 19 is connected on one of its ends through pinion gear 20 to an upper tooth gear 43. One of several interlocking gears 21 is supported for rotation upon the same axle 14 which is connected to upper tooth gear 43. Each gear 21 is supported for rotation upon a different axle 14, the axle 14 supporting the rearmost gear 21 being also connected to rear engine wheel 12 which contacts one side portion of middle rail support 9. Although not shown, it is contemplated for the second embodiment of engine assembly 1 to have five gears 21 and two rear engine wheels 12. Also, although not shown, it is contemplated for each rear engine wheel 12 to be spring biased for proper contact with middle rail member 9 as rear engine wheel 12 is subject to wear, and since too little or too much pressure forcing rear engine wheel 12 in contact with middle rail member 9 will prevent engine assembly 1 from moving. Gears 21 are supported in their operational positions by axles 14 and drive subassembly frame 22, which in the second embodiment comprises two parallel metal strips interconnected by fasteners 46 each having a central spacer (not shown). Drive frame assembly 22 further comprises several vertically oriented gear support bars 45. The number and positioning of the metal strips in drive subassembly frame 22, fasteners 46, and gear support bars 45 are not critical to the present invention, as long as gears 21 are adequately supported for efficient operation. FIG. 7 also shows a reduced-size engine tire 44 above positioned above rear engine wheel 12.

Figure 8:
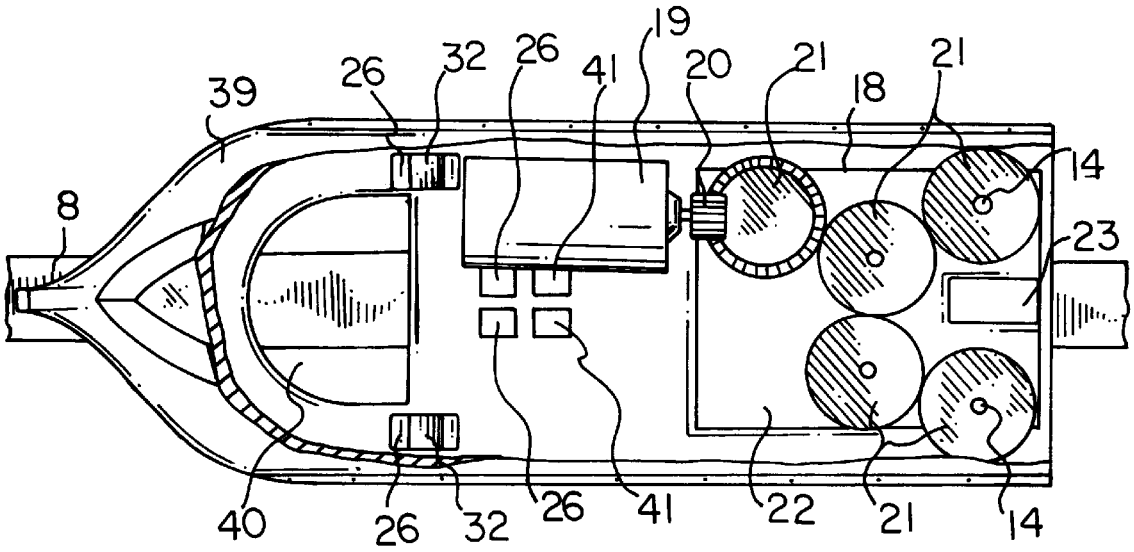
FIG. 8 is a top view of the base member of the second embodiment of the engine assembly.

FIG. 8 shows engine base 39 of the second embodiment of engine assembly 1 having front wheel opening 40. Laterally to and rearward from front wheel opening 40 on each of its sides, FIG. 8 shows an attachment block 26 with a safety arm subassembly 32 connected thereto. Centrally rearward from front wheel opening 40 FIG. 8 shows two attachment blocks 26, and immediately rearward thereto, two side-by-side electrical pickup openings 41. FIG. 8 also shows direct current motor 19 positioned rearward to one safety arm subassembly 32 and connected on one of its ends to gears 21 within drive subassembly 18 by pinion gear 20. FIG. 8 shows five interconnecting gears 21 positioned so that two rearwardmost gears 21 are located on either side of rear wheel opening 23. Although not shown in FIG. 8, one rear engine tire 12 is supported for rotation upon the same axle 14 used for support of each rearwardmost gear 21.

Figure 9:
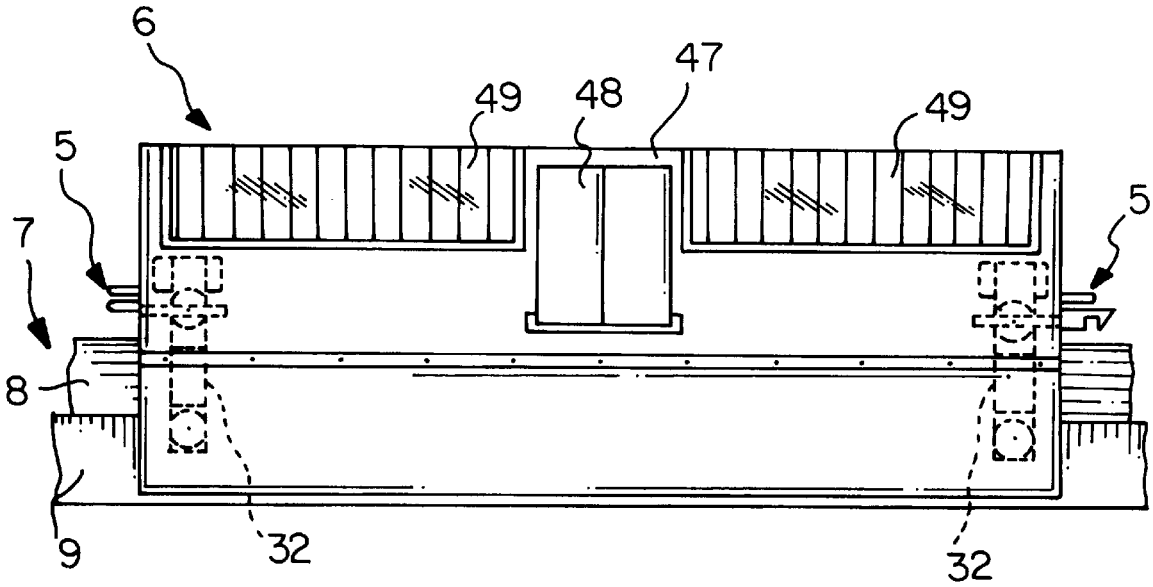
FIG. 9 is a side view of a passenger car assembly.

FIG. 9 shows a first embodiment of car assembly 6 configured as a passenger car and positioned on upper rail member 8 of rail assembly 7. FIG. 9 shows car assembly 6 having a car shell 47 extending downwardly to cover most of middle rail member 9, a door 48 centrally positioned on the portion of car shell 47 positioned above rail assembly 7, one window 49 located on each side of door 48, one wheel-coupler assembly 5 attached to each end of car assembly 6, and two safety arm subassemblies 32 also connected to car assembly 6 adjacent to each of its ends. Although not shown, it is also contemplated for the opposed side of car assembly 6 to comprise windows 49, door 48, and two safety arm subassemblies 32. In the first preferred embodiment of car assembly 6, it is contemplated for the wheel-coupler assembly 5 on one of its ends to have a female coupler 37 attached thereto and the wheel-coupler assembly 5 on the other of its ends to have a male coupler 54 attached thereto.

Figure 10:
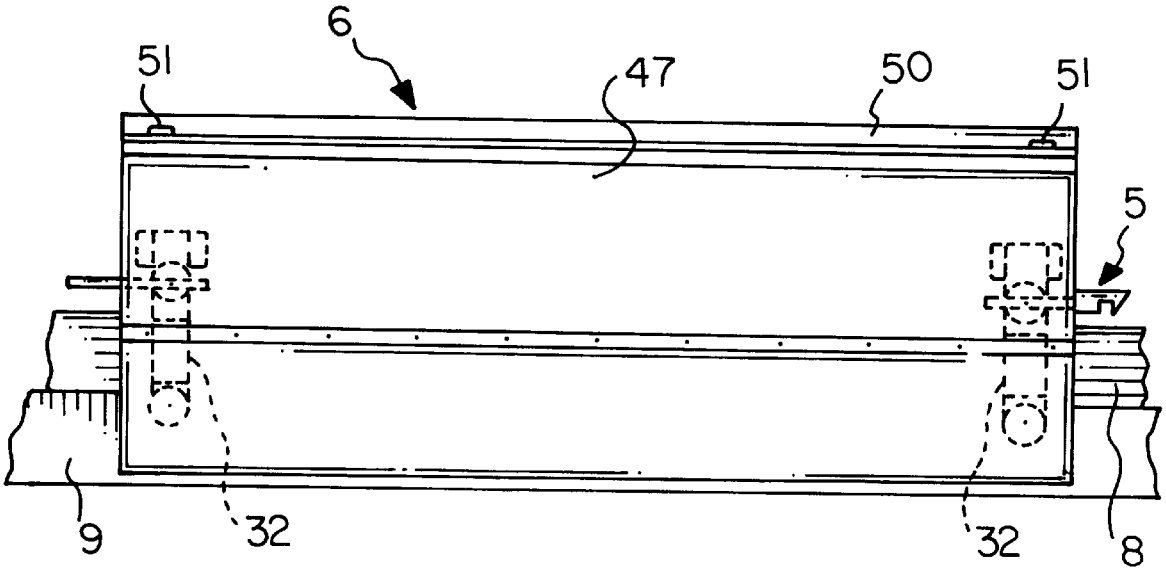
FIG. 10 is a side view of a freight car assembly.
Figure 11:
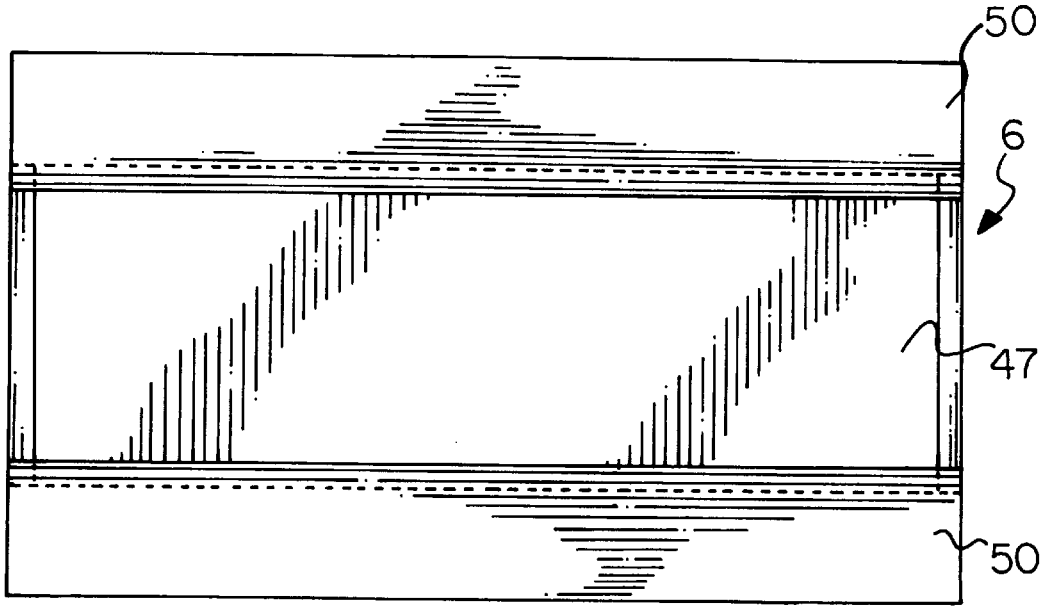
FIG. 11 is a top view of a freight car assembly having cargo doors in an opened position.

FIG. 10 shows a second embodiment of car assembly 6 configured as a freight car and positioned on upper rail member 8 of rail assembly 7. FIG. 10 shows car assembly 6 having car shell 47 extending downwardly below the bottom surface of upper rail member 8, a cargo door 50 connected to the upper surface of car shell 47 by two cargo door pins 51, one wheel-coupler assembly 5 attached to each end of car assembly 6, and two safety arm subassemblies 32 also connected to car assembly 6 adjacent to each of its ends. Although not shown, it is also contemplated for the opposed side of car assembly 6 to comprise cargo door 50, two cargo door pins 51, and two safety arm subassemblies 32. In the second preferred embodiment of car assembly 6, it is contemplated for the wheelcoupler assembly 5 on one of its ends to have a female coupler 37 attached thereto and the wheel-coupler assembly 5 on the other of its ends to have a male coupler 54 attached thereto. FIG. 11 shows the second embodiment of car assembly 6 having a car shell with two cargo doors 50 attached thereto, each in and opened position.

Figure 12:
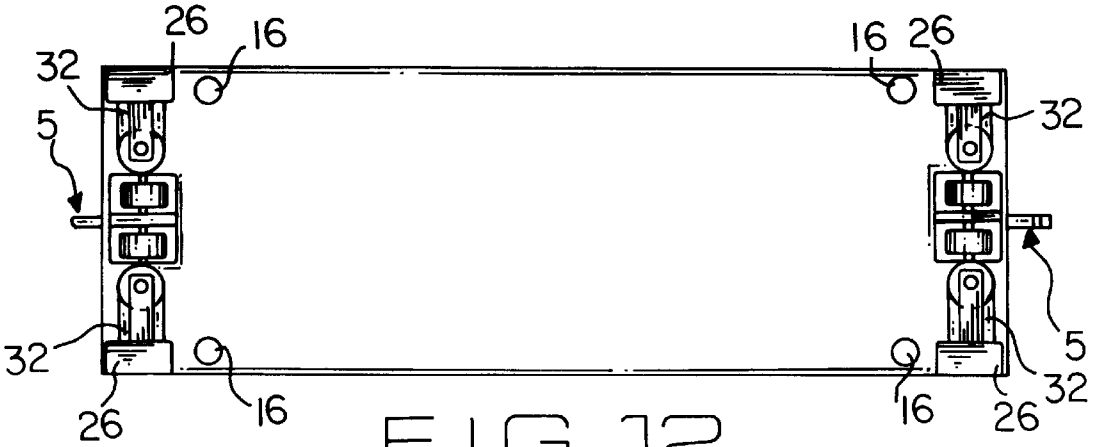
FIG. 12 is a top view of a car base.

FIG. 12 shows a car base 53 positioned upon upper rail member 8 and having four safety arm subassemblies 32, each mounted on an attachment block 26 and positioned adjacent to one of the outside corners of car base 53. FIG. 12 also shows car base 53 having one wheel-coupler subassembly 5 centrally positioned adjacent to each of its ends and four fastener holes 16 with each fastener hole 16 positioned laterally adjacent to one attachment block 26. Fastener holes 16 provide a means of connecting car base 53 to car shell 47. Although not shown, in the preferred embodiment it is contemplated for a conventional screw to be inserted through each fastener hole 16 and secured therein with a conventional nut.

Figure 13:
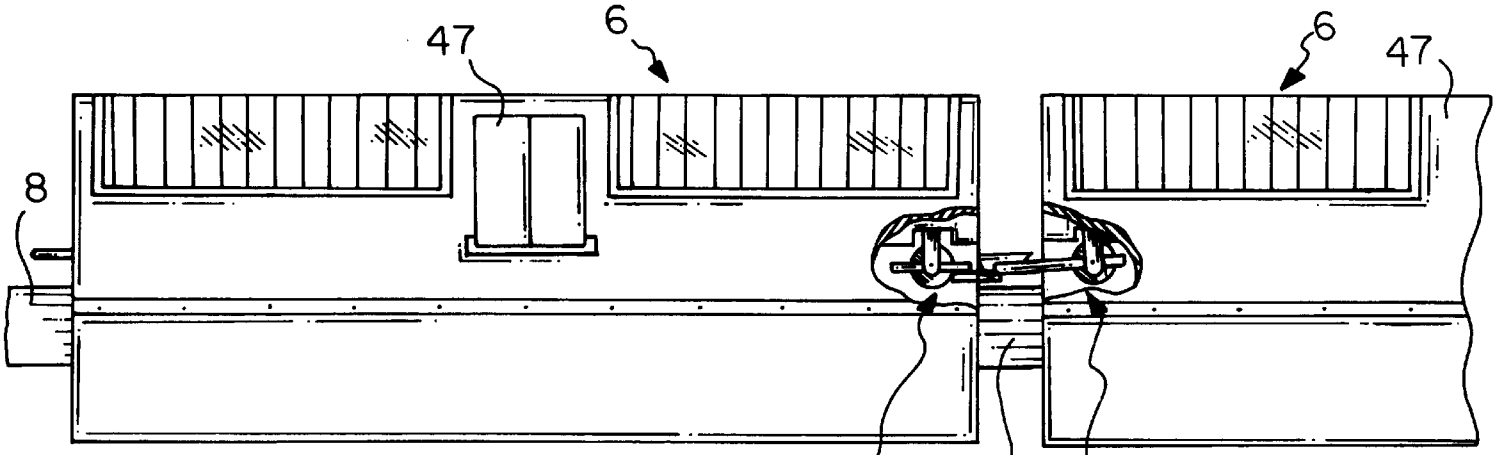
FIG. 13*a* is a side view of two coupled cars.
FIG. 13*b* is a top view of a coupler.
FIG. 13*c* is a side view of a male coupler connected to a car wheel.

FIG. 13*a* shows two car assemblies 6 coupled together. One wheel-coupler assembly 5 on each car assembly 6 being interconnected to one wheel-coupler assembly 5 on the adjacent car assembly 6. To achieve coupling, one car assembly 6 must comprise female coupler 37 on the distal end of its wheel-coupler assembly 5 for joining with an adjacent car assembly 6 comprising male coupler 54 on the distal end of its wheel-coupler assembly 5 by inserting a hook on male coupler 54 behind a cross piece on the end of female coupler 37. Since wheel-coupler assemblies 5 are positioned near to the upper surface of upper rail member 8, wheel-coupler assemblies 5 are designed so that no component extends sufficiently downward therefrom to interfere with movement of engine assemblies 1 along the upper surface of upper rail member 8.

Figure 13B:
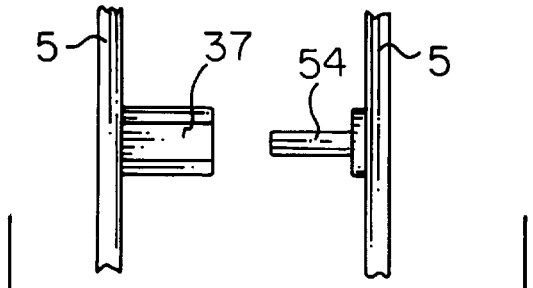
Figure 13C:
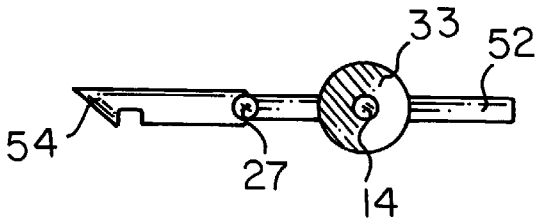

FIG. 13*b* shows female coupler 37 on one wheel-coupler assembly 5 positioned in opposition to male coupler 54 attached to a separate wheel-coupler assembly 5. FIG. 13*c* shows wheel-coupler assembly 5 having male coupler 54 attached to one end of a wheel assembly support member 52. FIG. 13*c* also shows roller 33 supported for rotation on axle 14 which is connected to wheel assembly support member 52, and a pivot point 27 connected between roller 33 and male coupler 54 to allow car assembly 6 flexibility to move along curved sections of rail assembly 7.

Figure 14A:
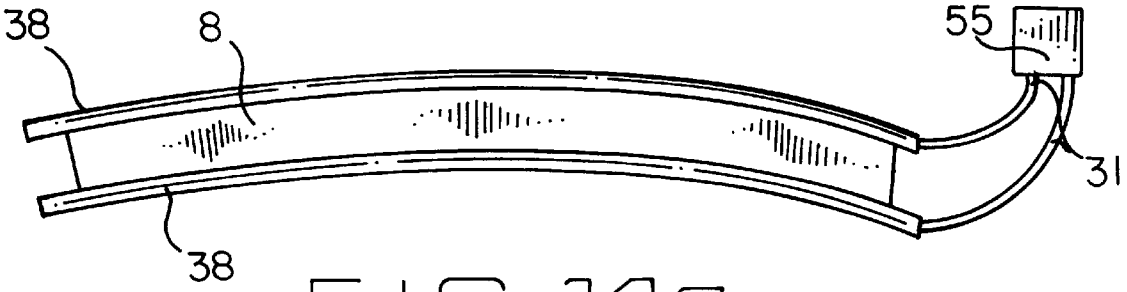
FIG. 14*a* is a top view of an upper rail member.

FIG. 14*a* shows the upper surface of upper rail member 8 having two electrically conductive strips 38 laterally positioned thereon. FIG. 14*a* also shows electrically conductive strips 38 connected by wiring 31 to a direct current power source 55. In the preferred embodiment it is contemplated for direct current power source 55 to comprise at least one 10-volt battery.

Figure 14B:
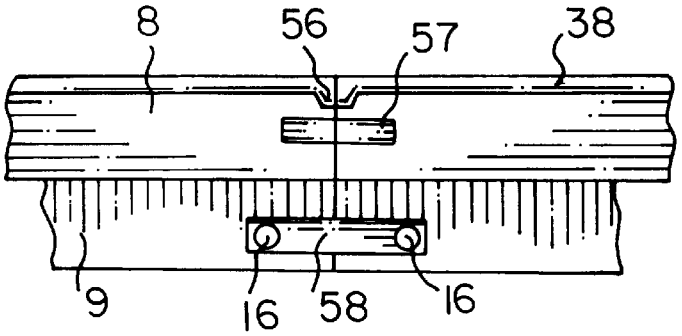
FIG. 14*b* is a side view of two upper rail members connected together.

FIG. 14*b* shows the ends of two upper rail members 8 connected together. FIG. 14*b* shows a groove 56 in the upper surface of each end of each upper rail member 8 and into which electrically conductive strips 38 from both upper rail members 8 are placed to ensure the continuation of electrical current from one upper rail member 8 to the next. Also, each end of upper rail member 8 has a bore 57 centrally located therein. Although not shown, it is contemplated for a peg to be inserted into bore 57 to further strengthen the connection between one upper rail member 8 and the next adjacent upper rail member 8. In addition, FIG. 14*b* shows a fastening plate 58 having one fastener hole 16 through each of its ends and positioned across the bottom portions of the middle rail members 9 supporting each upper rail member 8. In the preferred embodiment it is contemplated for fastening plates 58 to be secured to adjacent middle rail members 9 by conventional screws. Although not shown, it is contemplated for at least one fastening plate 58 to be connected on each side of a connection between adjacent middle rail members 9.

Figure 15A:
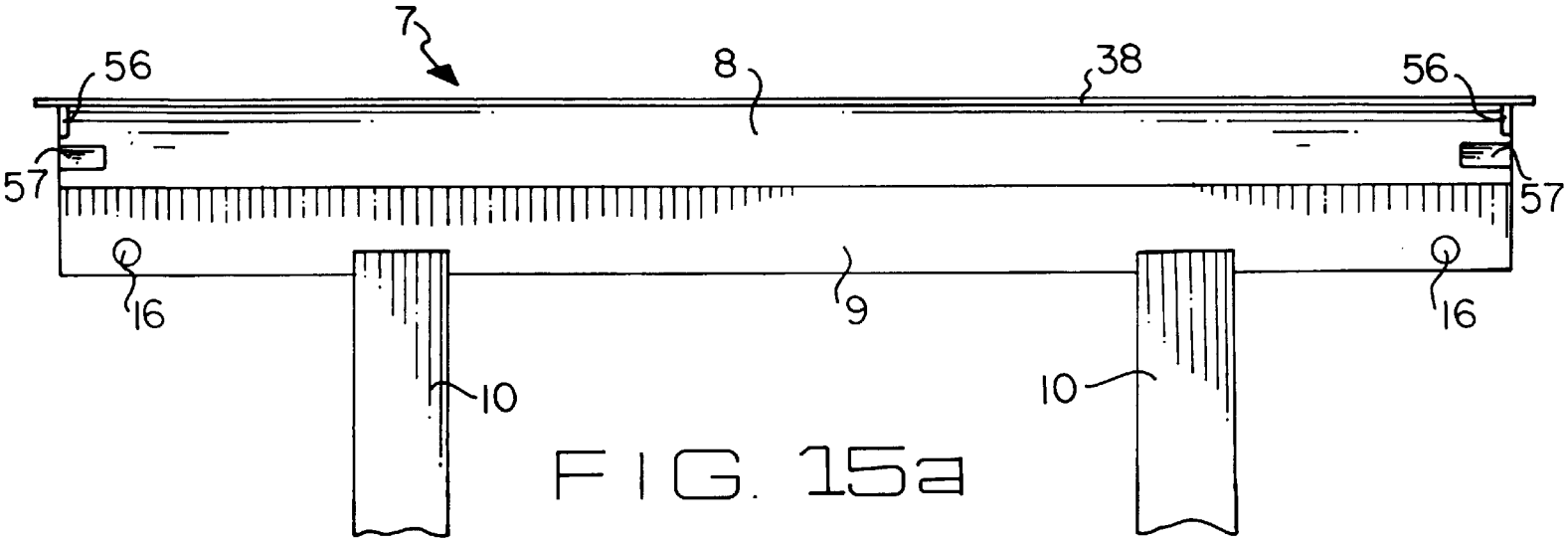
FIG. 15*a* is a side view of a rail assembly.
Figure 15B:
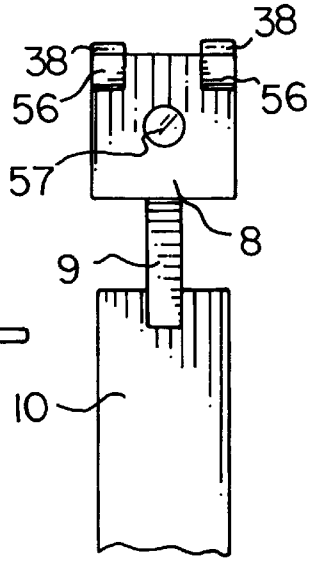
FIG. 15*b* is an end view of a rail assembly.

FIG. 15*a* shows rail assembly 7 having upper rail member 8 positioned upon the upper surface of middle rail member 9 and several upright rail supports 10 supporting the bottom surface of middle rail member 9. Electrically conductive strip 38 is positioned upon the upper surface of upper rail member 8. In addition, FIG. 15a shows both ends of upper rail member 8 having groove 56 and bore 57 therein, and middle rail member 9 having fastener holes 16 for attachment thereto of one fastening plate 58.

FIG. 5*b* shows rail assembly 7 having upper rail member 8 positioned upon the upper surface of middle rail member 9 and the bottom and lower side surfaces of middle rail member 9 positioned within the upper surface of upright rail support 10. Two electrically conductive strips 38 are positioned laterally upon the upper surface of upper rail member 8. In addition, FIG. 15*a* shows the end of upper rail member 8 having two grooves 56 and one bore 57 therein. The means of connecting upper rail member 8 to middle rail member 9 and middle rail member 9 to each upright rail support 10 is not critical to the present invention, as long as each is securely fastened to the other. However, in the preferred embodiment it is contemplated for the components of rail assembly 7 to be fastened together with varying combinations of screws, pegs, and adhesives.

Figure 16:
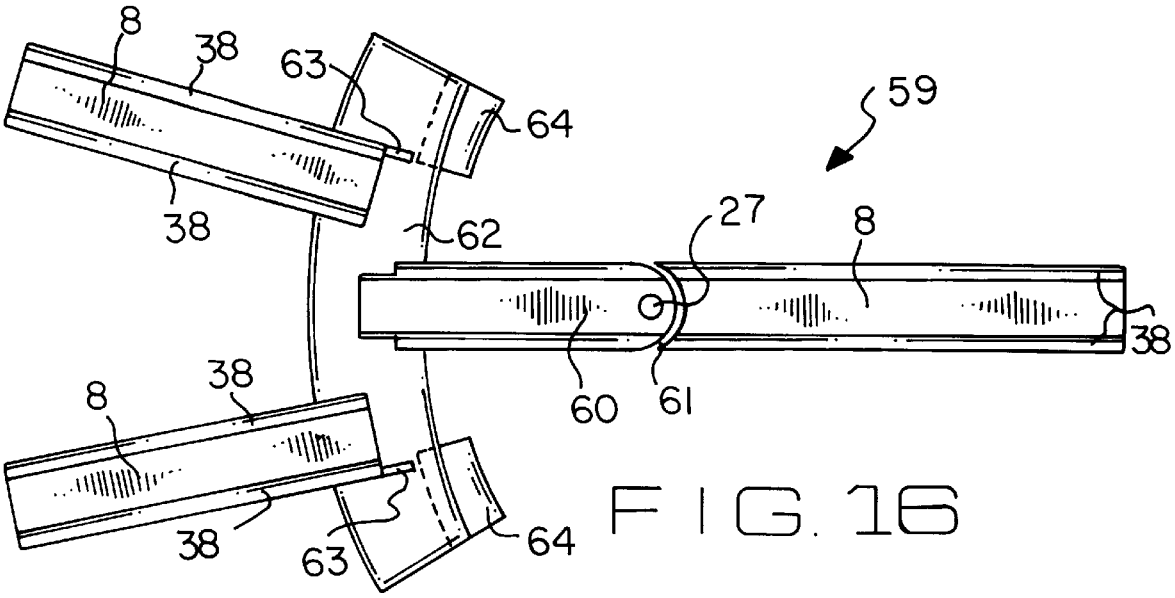
FIG. 16 is a top view of a switch subassembly.

FIG. 16 shows a switch subassembly 59 having one incoming upper rail member 8 and two outgoing upper rail members 8, each upper rail member 8 having two electrically conductive strips 38 laterally positioned on its upper surface. FIG. 16 shows one end of incoming upper rail member 8 positioned adjacent to a swivel track member 60, with a gap 61 therebetween and a pivot point 27 located on the incoming end of swivel track member 60. FIG. 16 also shows one end of both outgoing upper rail members 8 supported on a switch support member 62 to which electromagnets 64 are laterally attached. Each end of outgoing upper rail member 8 which is attached to switch support member 62 has a switch stop 63 connected thereto on its outside edge, and the distal end of swivel track member 60 is configured to engage switch stops 63, to define the outer limits of movement of swivel track member 60. Each switch stop 63 is positioned so that electrically conductive strips 38 on the adjoining end of swivel track member 60 align with electrically conductive strips 38 on the adjoining end of each outgoing upper rail member 8 to ensure continued movement of engine assembly 1 from swivel track member 60 to one of the outgoing upper rail members 8 supported by switch support member 62.

Figure 17:
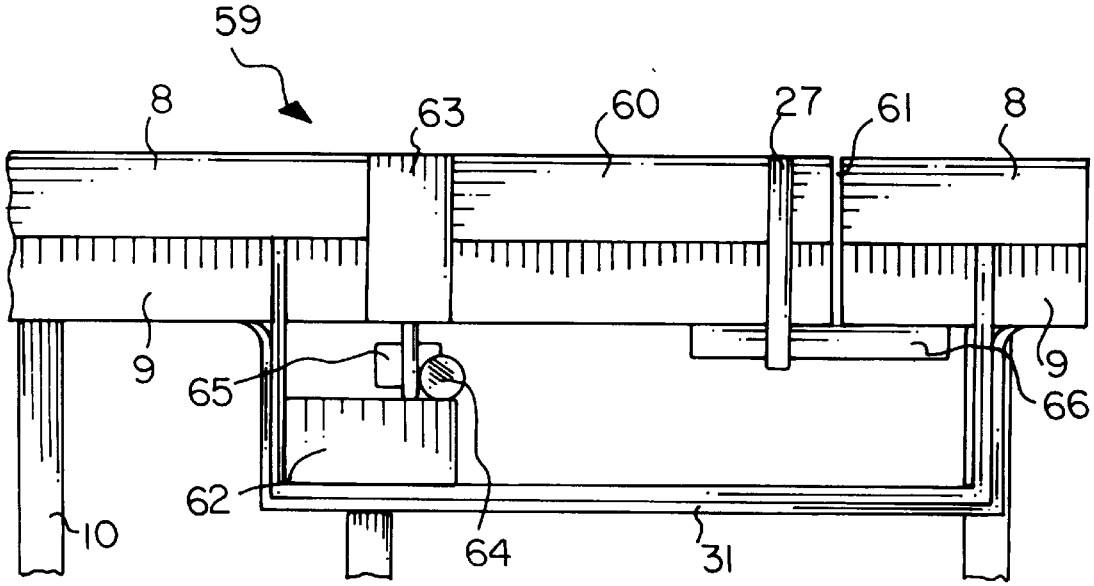
FIG. 17 is a side view of the switch subassembly.

FIG. 17 shows switch subassembly 59 having incoming and outgoing upper rail members 8 positioned on opposing ends thereof FIG. 16 shows one end of incoming upper rail member 8 positioned adjacent to a swivel track member 60, with a gap 61 therebetween and a pivot point 27 located adjacent to the incoming end of swivel track member 60. FIG. 16 shows the lower end of pivot point 27 attached to a swivel support member 66 which is also connected to an adjacent upright rail support 10. FIG. 16 also shows one end of outgoing upper rail member 8 supported upon switch support member 62 to which electromagnet 64 is attached. A metal plate 65 connected to the lower portion of each side of swivel track member 60 attracts swivel track member 60 alternately toward each opposed electromagnet 64. FIG. 16 further shows switch stop 63 connected to the end of outgoing upper rail member 8 positioned upon switch support member 62, and wiring 31 connected to electromagnet 64, as well as outgoing upper rail member 8.

Figure 18:
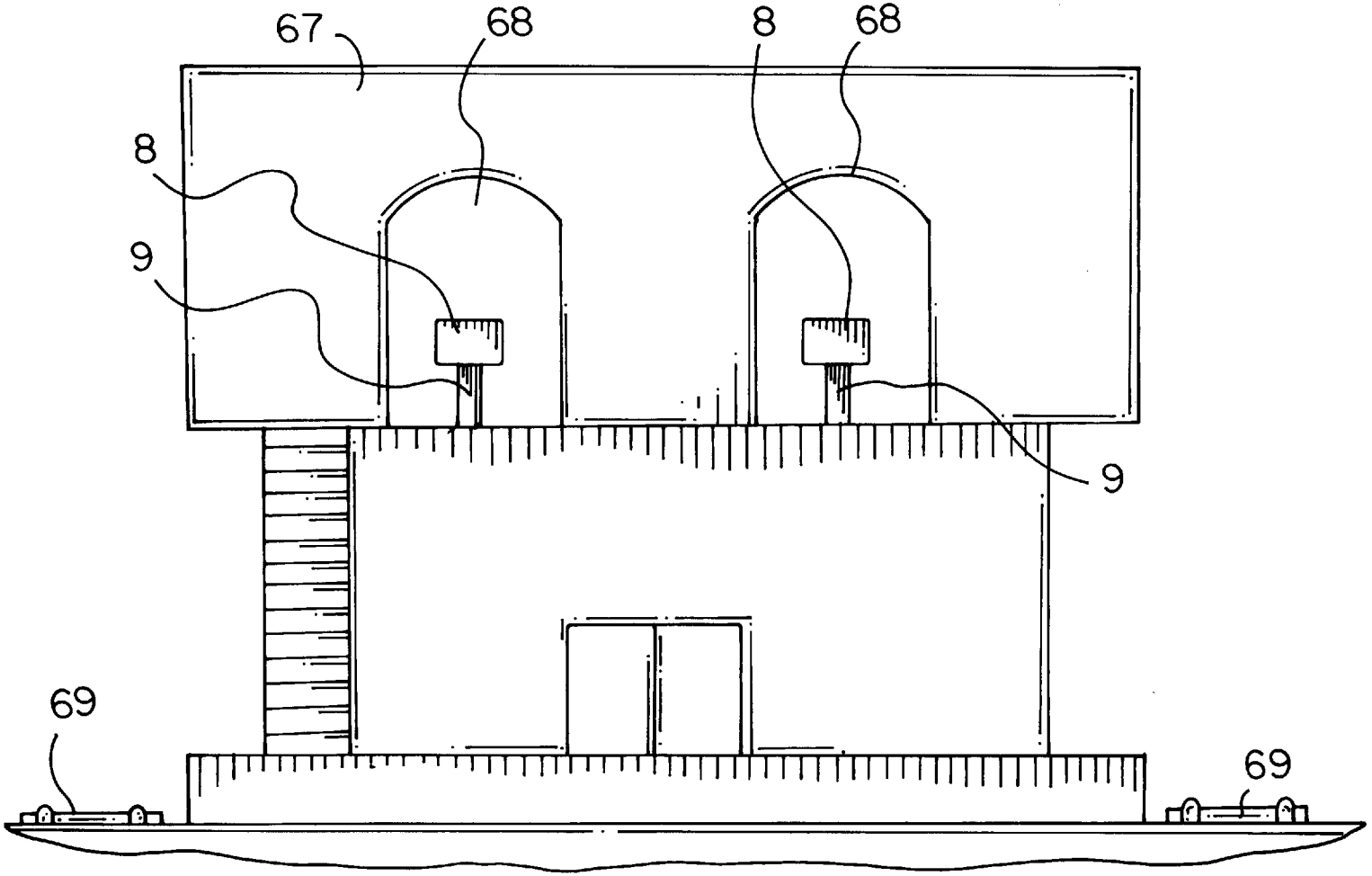
FIG. 18 is an end view of two rail assemblies and two model railroad track assemblies connected to a building.

FIG. 18 shows a building 67 having two openings 68 therethrough, each opening 68 being of sufficient size for movement therethrough of one engine assembly 1 positioned on the upper surface of one upper rail member 8 that is supported on top of one middle rail member 9. Openings 68 are shown through the upper portion of building 67 so that upper rail member 8 will connect seamlessly with rail assemblies 7 positioned adjacent thereto. FIG. 17 also shows building 67 positioned between two model railroad track assemblies 69 so that the present invention can be used in conjunction with model railroad systems (not shown).

In the preferred embodiment of the present invention it is contemplated to have two engine assemblies 1, three car assemblies 6, sixteen straight rail assemblies 7 which are each eight inches in length, fourteen curved rail assemblies 7 that are each eight inches in length, one ten-volt direct current power supply 55, and electrically conductive strips 38 which are made from copper and are one-eighth of an inch in width for lateral connection to the upper surfaces of each upper rail member 8. In addition, in the preferred embodiment engine shell 2, engine base 39, car shell 47, and car base 53 are made from plastic. It is contemplated for the present invention to be made to any scale or dimension. However, when made for use with HO Gauge model railroad systems (not shown), rollers 33 have a diameter of approximately one-fourth of an inch, engine wheels 12 have a diameter of approximately three-fourths of an inch, reduced-size engine wheel 44 has a diameter of approximately one-half of an inch, pinion gear 20 has a diameter of approximately one-half of an inch, gears 21 have a diameter of approximately three/fourths of an inch, axles 14 supporting engine wheels 12 and rollers 33 to have a diameter of approximately one-thirty-secondths of an inch, and axles 14 supporting gears 21 to have a diameter of approximately one-eighth of an inch. The present invention would also comprise plastic stock which is approximately one-fourth of an inch square and plastic stock which has a cross-sectional dimension of approximately one-fourth of an inch by one-eighth of an inch.

To use the present invention one would position engine assemblies 1, and any car assemblies 6 coupled thereto, onto an access end of rail assembly 7. After connection of electrically conductive strips 38 on the upper surfaces of upper rail members 8 to a direct current power supply 55, electrical pick-up subassemblies 25 housed partially within engine shell 2 with downwardly extending lower ends of electrical pick-ups 29 in contact with electrically conductive strips 38 draw power therefrom to operate direct current motor 19 and cause gears 21 to rotate rear engine wheels 12 so as to move engine assemblies 1 and any car assemblies 6 coupled thereto along rail assembly 7. It is contemplated to have more than one engine assembly 1 connected together to pull larger numbers of car assemblies 6 or car assemblies 6 loaded with passengers or cargo (not shown). It is also contemplated for headlight 4 to be activated while engine assembly 1 is moving, and for safety arm subassemblies 32 and roller arm subassemblies 35 to maintain engine assemblies 1 and car assemblies 6 in operational position upon the upper surface of upper rail member 8 at speed. Weights 30 attached to electrical pick-up guides 28 help to maintain engagement of the lower ends of electrical pick-ups 29 with electrically conductive strips 38 during operation of engine assemblies 1. Also, pivot points 27 in electrical pick-up assemblies 25, switch subassembly 59, wheel-coupler assemblies 5, as well as the inner wheel frame 15 connection to outer wheel frame 17, allow engine assemblies 1 to follow curved portions of rail assembly 7.

What is claimed is:

1. A model monorail system comprising an engine having a hollow engine shell, an engine base connected to said shell, a front wheel assembly attached to said engine base, said front wheel assembly pivotally housing a front engine wheel, a drive subassembly positioned within said engine shell and connected to both said engine base and said engine shell, said drive subassembly having a direct current motor, at least one rear engine wheel driven by said direct current motor, at least one electrical pick-up subassembly for receiving power to operate said direct current motor, said electrical pick-up subassemblies electrically connected to said motor, a plurality of rollers, a plurality of safety arm subassemblies each comprising at least two of said rollers, at least two of said safety arm subassemblies being connected to said engine base, and a plurality of roller arm subassemblies each comprising at least one of said rollers, at least two of said roller arm subassemblies being connected to said engine base; a monorail track comprising a plurality of rail assemblies each connected to at least one other of said rail assemblies and each comprising an upper rail member having an upper surface, sides, opposite ends, and a bottom surface, a middle rail member, said middle rail member being connected to said bottom surface of said upper rail member, said middle rail member having a lower surface and lower side surfaces, a plurality of upright rail supports, said rail supports being attached around said lower surfaces and said lower side surfaces of said middle rail member, each of said rollers on each of said roller arm subassemblies being positioned during operation of said engine assembly to engage one of said sides of said upper rail members, at least one of said rollers on each of said safety arm subassemblies being positioned during operation of said engine assembly to engage one of said sides of said upper rail members and at least one of said rollers on each of said safety arm subassemblies being positioned during operation of said engine assembly to engage said bottom surface of said upper rail members, a plurality of electrically conductive strips, at least one of said electrically conductive strips being positioned on said upper surface of each of said upper rail members, and means to connect said ends of adjacent ones of said upper rail members to one another and said ends of adjacent ones of said middle rail members to one another to form said monorail track so that electrical current can be transported from said electrically conductive strips on one of said upper rail members to said electrically conductive strips which are attached to the one of said upper rail members next adjacent thereto, a direct current power source; and a sufficient quantity of wiring to electrically connect said electrical pick-up subassembly to said direct current motor and said electrically conductive strips to said direct current power source so that when said engine assembly is positioned upon said upper surface of said upper rail members, said electrical pick-ups contact said electrically conductive strips to draw power therefrom to move said engine assembly along said monorail track.

2. The system of claim 1 wherein said engine assembly also has a female coupler attached thereto, and wherein said system further comprises at least one car assembly having a car shell, a car base, at least two of said safety arm subassemblies, and two wheel-coupler subassemblies each comprising at least one of said rollers, one of said wheel-coupler subassemblies on each of said car assemblies comprising a male coupler for attachment to said female coupler on said engine assembly, each of said wheel-coupler subassemblies also comprising at least two of said rollers for movement of said car assembly along said upper surface of said upper rail members and a pivot point to allow said car assemblies to move along curved sections of said rail assembly, said safety arm subassemblies each having a plurality of said rollers to center said car assembly upon said upper rail member and a plurality of said rollers to engage said bottom surface of said upper rail member to prevent said car assemblies from becoming separated from said monorail track at speed.

3. The system of claim 2 wherein said car assembly is configured as a passenger car having a plurality of windows on said car shell and at least one door positioned on said car shell.

4. The system of claim 2 wherein said car assembly is configured as a freight car having a plurality of cargo doors which are movably mounted to said car shell for placement in closed and opened positions.

5. The system of claim 4 wherein said car shell has a top surface and said cargo doors are positioned with a plurality of door pins to said top surface for overhead movement between opened and closed positions.

6. The system of claim 1 wherein said drive subassembly also comprises a pinion gear connected to said direct current motor, and three interlocking gears connected between said pinion gear and said rear engine wheel.

7. The system of claim 1 wherein said drive subassembly also comprises a pinion gear connected to said direct current motor, an upper tooth gear connected to said pinion gear, five interlocking gears connected between said upper tooth gear and two of said rear engine wheels which counter-against said sides of said upper rail member to drive said engine assembly along said rail assembly, and one reduced-size engine wheel for support of said engine assembly upon said upper surface of said upper rail member.

8. The system of claim 7 further comprising means to bias said two rear engine wheels against said sides of said upper rail member to account for wear of said two engine wheels during use.

9. The system of claim 1 further comprising a plurality of switches, each of said switches having an incoming upper rail member and two outgoing upper rail members, each of said outgoing upper rail members having an outside edge, a swivel track member having opposite sides and positioned adjacent to said incoming upper rail member, a gap separating said swivel track member from said incoming upper rail member, said swivel track member having a pivot point, a swivel support member supporting said pivot point, each of said outgoing upper rail members supported on a switch support member, a switch stop connected to said outside edge of each of said outgoing upper rail members near to said swivel track member and positioned to engage said swivel track member when said swivel track member is selectively pivoted so as to align said electrically conductive strips on said swivel track member with said electrically conductive strips on the one of said outgoing upper rail members to which said swivel track member becomes pivotally aligned, an electromagnet laterally connected to each of said switch support members, and a metal plate connected to each of said opposite sides of said swivel track member in a position for selective attraction to one of said electromagnets so that an engine assembly positioned on said incoming upper rail member can be transferred for movement onto a selected one of said outgoing upper rail members.

10. The system of claim of claim 1 further comprising at least one building associated with said monorail track, each of said buildings having a plurality of openings therethrough, each of said openings sufficiently dimensioned to house one of said engine assemblies positioned upon one of said upper rail members, and further supported by one of said middle rail members.

11. The system of claim 10 wherein said building also has a quantity of model railroad track associated therewith for use of said system with model railroad systems dimensioned for use with said railroad track.

12. The system of claim 1 wherein each of said electrical pick-up assemblies comprise an electrical pick-up having an upper portion and a lower portion, an electrical pick-up guide positioned over said upper rail member to guide said electrical pick-ups along curved sections of said rail assembly, a weight positioned above said lower portion of said electrical pick-up and in contact therewith to bias said lower portion of said electrical pick-up downwardly against said electrically conductive strips on each of said upper rail members, said weight being supported by said electrical pick-up guide, said electrical pickups also each having a pivot point positioned between said upper portion and said lower portion for help in moving said electrical pickups horizontally along curved sections of said monorail track, said electrical pick-ups each being connected to an attachment block attached to said engine base which allows vertical movement of said upper portion of said electrical pick-up relative to said upper rail members.

13. The system of claim 1 wherein said front wheel assembly comprises an axle supporting said front engine wheel, an inner wheel frame having an inverted U shape and supporting said axle, four wheel guides connected to said inner wheel frame to guide said front engine wheel along said sides of said upper rail member, and an outer wheel frame having an inverted U shape and connected to said inner wheel frame through a centrally positioned fastener hole, said outer wheel frame also having two flanges laterally depending therefrom, each flange having a fastener hole therethrough, each of said fastener holes in said flanges being used to connect said front wheel assembly to said engine base.

14. The system of claim 1 wherein each of said safety arm assemblies comprise an inverted F-shaped roller support member, two of said rollers attached thereto with one of said rollers being above the other, the one of said rollers which is positioned above the other being used to center said engine assembly on said upper rail member, the lower of said rollers being used to prevent said engine assembly from being lifted upward from said upper rail member, and said inverted F-shaped roller support member having a fastener hole therein for attachment to said engine base.

15. The system of claim 1 wherein each of said roller arm assemblies comprise a roller support member, an axle attached to said roller support member, and one of said rollers mounted for rotation on said axle to help center said engine assembly upon said upper rail member.

16. A model monorail system comprising an engine assembly having a hollow engine shell with a female coupler attached thereto, an engine base connected to said shell, a front wheel assembly attached to said engine base, said front wheel assembly pivotally housing a front engine wheel, a drive subassembly positioned within said engine shell and connected to both said engine base and said engine shell, said drive subassembly having a direct current motor, a plurality of rear engine wheels with at least one of said rear engine wheels being driven by said direct current motor, at least one electrical pick-up subassembly for receiving power to operate said direct current motor, said electrical pick-up subassembly being electrically connected to said motor, a plurality of rollers, a plurality of safety arm subassemblies each comprising at least two of said rollers, at least two of said safety arm assemblies being connected to said engine base, and a plurality of roller arm subassemblies each comprising at least one of said rollers, at least two of said roller arm assemblies being connected to said engine base; a monorail track comprising a plurality of rail assemblies each connected to at least one other of said rail assemblies and each comprising an upper rail member having an upper surface, sides, opposite ends, and a bottom surface, a narrow middle rail member, said middle rail member being connected to said bottom surface of said upper rail member, said middle rail member having a lower surface and lower side surfaces, a plurality of upright rail supports, said rail supports being attached around said lower surfaces and said lower side surfaces of said middle rail member, each of said rollers on each of said roller arm subassemblies being positioned during operation of said engine assembly to engage one of said sides of said upper rail members, one of said rollers on each of said safety arm subassemblies being positioned during operation of said engine assembly to engage one of said sides of said upper rail members and at least one of said rollers on each of said safety arm subassemblies being positioned during operation of said engine assembly to engage said bottom surface of said upper rail members, a plurality of electrically conductive strips, at least one of said electrically conductive strips being positioned on said upper surface of each of said upper rail members; means to connect said ends of adjacent ones of said upper rail members to one another and said ends of adjacent ones of said middle rail members to one another to form said monorail track so that electrical current can be transported from said electrically conductive strips on one of said upper rail members to said electrically conductive strips which are attached to the one of said upper rail members next adjacent thereto, a direct current power source; a sufficient quantity of wiring to electrically connect said electrical pick-up subassemblies to said direct current motor and said electrically conductive strips to said direct current power source so that when said engine assembly is positioned upon said upper surface of said upper rail member, said electrical pick-ups contact said electrically conductive strips to draw power therefrom to move said engine assembly along said monorail track; at least one car assembly having a car shell, a car base, at least two of said safety arm subassemblies, and two wheel-coupler subassemblies each comprising at least one of said rollers, one of said wheel-coupler subassemblies on each of said car assemblies comprising a male coupler for attachment to said female coupler on said engine assembly, each of said wheel-coupler subassemblies also comprising at least two of said rollers for movement of said car assembly along said upper surface of said upper rail members and a pivot point to allow said car assemblies to move along curved sections of said rail assembly, said safety arm subassemblies each having a plurality of said rollers to center said car assembly upon said upper rail member and a plurality of said rollers to engage said bottom surface of said upper rail member to prevent said car assemblies from becoming separated from said monorail track at speed; wherein said drive subassembly also comprises a pinion gear connected to said direct current motor, an upper tooth gear connected to said pinion gear, five interlocking gears connected between said upper tooth gear and two of said rear engine wheels which counter-against said sides of said upper rail member to drive said engine assembly along said upper surface of said upper rail member, one reduced-sized engine wheel for support of said engine assembly upon said upper surface of said upper rail member, and means to bias said two rear engine wheels against said sides of said upper rail member to account for wear of said two rear engine wheels during use; a plurality of switches, each of said switches having an incoming upper rail member and two outgoing upper rail members, each of said outgoing upper rail members having an outside edge, a swivel track member having opposite sides and positioned adjacent to said incoming upper rail member, a gap separating said swivel track member from said incoming upper rail member, said swivel track member having a pivot point, a swivel support member supporting said pivot point, each of said outgoing upper rail members supported on a switch support member, a switch stop connected to said outside edge of each of said outgoing upper rail members near to said swivel track member and positioned to engage said swivel track member when said swivel track member is selectively pivoted so as to align said electrically conductive strips on said swivel track member with said electrically conductive strips on the one of said outgoing upper rail members to which said swivel track member becomes pivotally aligned, an electromagnet laterally connected to each of said switch support members, and a metal plate connected to each of said opposite sides of said swivel track member in a position for selective attraction to one of said electromagnets so that an engine assembly positioned on said incoming upper rail member can be transferred for movement onto a selected one of said outgoing upper rail members; said system further comprising at least one building associated with said monorail track, each of said buildings having a plurality of openings therethrough each of said openings sufficiently dimensioned to house one of said engine assemblies positioned upon one of said upper rail members, and further supported by one of said middle rail members; wherein each of said electrical pick-up assemblies comprise an electrical pick-up having an upper portion and a lower portion, an electrical pick-up guide positioned over said upper rail member to guide said electrical pick-ups along curved sections of said rail assembly, a weight positioned above said lower portion of said electrical pick-up and in contact therewith to bias said lower portion of said electrical pick-up downwardly against said electrically conductive strips on each of said upper rail members, said weight being supported by said electrical pick-up guide, said electrical pick-ups also each having a pivot point positioned between said upper portion and said lower portion for help in moving said electrical pickups horizontally along curved sections of said monorail track, said electrical pick-ups each being connected to an attachment block attached to said engine base which allows vertical movement of said upper portion of said electrical pick-up relative to said upper rail members; wherein said front wheel assembly comprises an axle supporting said front engine wheel, an inner wheel frame having an inverted U shape and supporting said axle, four wheel guides connected to said inner wheel frame to guide said front engine wheel along said sides of said upper rail member, and an outer wheel frame having an inverted U shape and connected to said inner wheel frame through a centrally positioned fastener hole, said outer wheel frame also having two flanges laterally depending therefrom, each flange having a fastener hole therethrough, each of said fastener holes in said flanges being used to connect said front wheel assembly to said engine base; wherein each of said safety arm subassemblies comprise an inverted F-shaped roller support member, two of said rollers attached thereto with one of said rollers being above the other, the one of said rollers which is positioned above the other being used to center said engine assembly on said upper rail members, the lower of said rollers being used to prevent said engine assembly from being lifted upward from said upper rail members, and said inverted F-shaped roller support member having a fastener hole therein for attachment to said engine base; and wherein each of said roller arm assemblies comprise a roller support member, an axle attached to said roller support member, and one of said rollers mounted for rotation on said axle to help center said engine assembly upon said upper rail members.

17. The system of claim 16 wherein said building also has a quantity of model railroad track associated therewith for use of said system with model railroad systems dimensioned for use with said railroad track.

* * * * *